US006793365B1

(12) United States Patent
Rieck

(10) Patent No.: US 6,793,365 B1
(45) Date of Patent: Sep. 21, 2004

(54) ILLUMINATED WINDOW DISPLAY

(76) Inventor: Jane S. Rieck, End of Britten Rd., Green Village, NJ (US) 07935

( * ) Notice: Subject to any disclaimer, the term of this patent is extended or adjusted under 35 U.S.C. 154(b) by 0 days.

(21) Appl. No.: 10/458,607

(22) Filed: Jun. 11, 2003

(51) Int. Cl.[7] ..... F21L 19/00

(52) U.S. Cl. ..... 362/162; 362/161; 362/392; 40/539; 40/561

(58) Field of Search ..... 362/163, 161, 362/392, 806; 40/539, 540, 541, 561, 564

(56) References Cited

U.S. PATENT DOCUMENTS 464,486 A * 12/1891 Von Der Hoya ..... 362/162
4,163,333 A * 8/1979 Kwiatkowski ..... 40/561
4,907,140 A * 3/1990 Overstreet ..... 362/162
5,264,995 A * 11/1993 McKee ..... 362/161
6,193,396 B1 * 2/2001 Winger et al. ..... 362/392
6,554,447 B1 * 4/2003 Kotary et al. ..... 362/161
6,554,448 B2 * 4/2003 Carpenter et al. ..... 362/161

* cited by examiner

*Primary Examiner*—Thomas M. Sember
*Assistant Examiner*—John Anthony Ward
(74) *Attorney, Agent, or Firm*—Charles I. Brodsky

(57) ABSTRACT

A window display in which illumination from a candlestick lines shines through an opening in a frame selected in correlation with a decorative display in providing an illumination presentation consistent with a holiday season of the year, or a secular or religious event or occasion in accordance with user preference, and of a composition and configuration to be detachable for folding flat for storage.

12 Claims, 2 Drawing Sheets

ILLUMINATED WINDOW DISPLAY

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to window displays, in general, and to an illuminated window display to reflect a time of year or to celebrate an occurrence or happening, in particular.

2. Description of the Related Art

As is well known and understood, window displays—and specifically illuminated window displays—profligate around Christmas time and to the 1–2 months thereafter, and then continue at a lesser rate during the remainder of the year. With the illumination frequently being provided by candlestick light, it is not unusual to see decorations of such type in many windows facing the street. By and large, however, such displays usually are of the candlestick light itself—typically colored white, blue or green—without much else. As will become clear from the following description, the illuminated window display of the present invention allows for a selected type of window presentation which affords more than just the candlestick light, but one which can be tailored to correlate with a holiday season of the year, with a secular or religious event, or with almost any other occasion one might think of, e.g. the birth of a newborn.

SUMMARY OF THE INVENTION

As will be seen below, the illuminated window display of the preferred embodiment incorporates a candlestick light, as before, together with a substantially vertical panel having a rearwardly extending shelf on which the candlestick light rests and a pre-cut configured opening for transmitting the illumination therethrough. One of a plurality of selectively interchangeable frames are included, coupled with the panel, with each of the frames having its own window opening in alignment with that of the pre-cut panel opening. One of a plurality of selectively interchangeable decorative displays of predetermined design are additionally included, insertably securable between the candlestick light and the one frame then in position in providing the illuminated presentation via the window opening. In accordance with the invention, the one selected frame and the one selected decorative display are selected in correlation consistent to provide an overall theme to the illuminated presentation afforded thereby. Thus, for example, the frame selected might be in the form of a trimmed blue spruce for a December-January showing, with a decorative display of Christmas Tree ornamentations shining through. For a St. Patrick's Day presentation in March, alternatively, the frame may be one of Leprechauns and Shillelaghs, with a decorative display of Shamrocks shining through.

With the candlestick light preferably providing an illumination of the order of 10 watts or less, the decorative display to shine through may be insertably secured between the candlestick light and the panel, on the one hand, or between he panel and the one selected frame, on the other hand.

In these preferred constructions, the substantially vertical panel, the individual decorative displays and the individual frames may each be attachable and foldably openable for use—while at the same time, detachable and foldably flattenable for storage. When opened, the decorative display selected for illumination may be secured by sliding within a holder on one of front and rear sides of the substantially vertical plane—which, in turn, could be secured with the panel by a hook-and-loop adhesive. Fabricating the substantially vertical panel and the selected frames of a plastic composition in this manner, or of a corrugated plastic or of a stiff cardboard composition as an alternative, allows the design of the decorative panel to shine through and to stand supported for use. Employing the candlestick light of this relative wattage affords the illumination needed to highlight the design when in a window placement, without their becoming too hot to manually turn off by a counterclockwise rotation, for example, of the bulb being employed. Because of the plastic or stiff cardboard composition of the components of the display, and because of the relatively low wattage of the candlestick light, such an illuminated window display could be manufactured at a low enough cost to permit retail sales at such an affordable price as to allow for multiple purchases for placements simultaneously in a multitude of windows.

As will be appreciated, the decorative display selected could be translucent to the illumination from the candlestick light—or opaque to it, but with cut-outs to pass portions of the illumination, only.

BRIEF DESCRIPTION OF THE DRAWINGS

These and other features of the present invention will be more clearly understood from a consideration of the following description, taken in connection with the accompanying Drawings, in which.

DETAILED DESCRIPTION OF THE INVENTION

Figure 1:
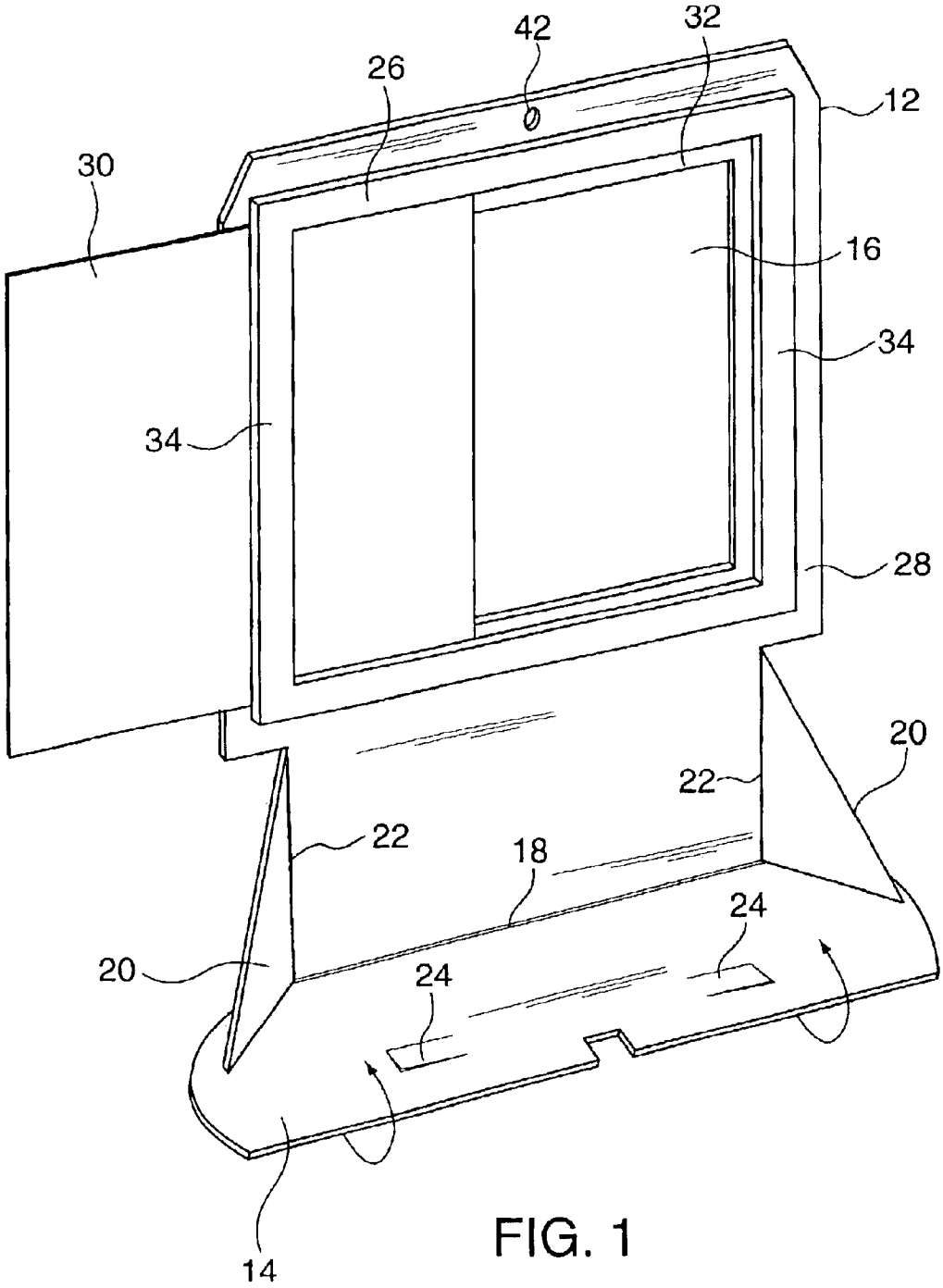
FIG. 1 is a rear perspective view of the substantially vertical panel and decorative display components of a preferred embodiment of the present invention.
Figure 2:
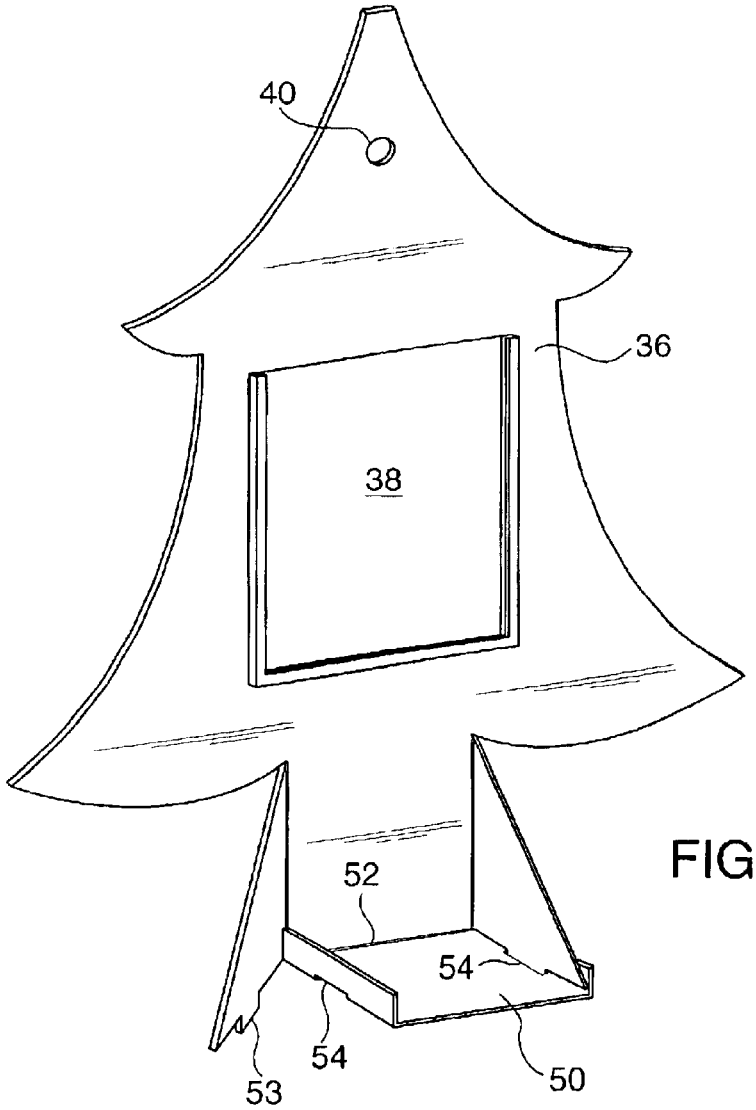
FIG. 2 is a rear perspective view of the surrounding frame component with its window opening for the illuminated presentation.
Figure 3:
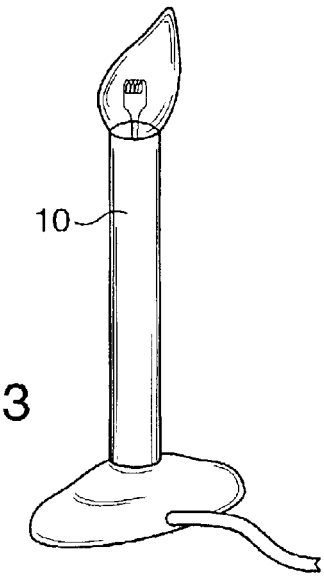
FIG. 3 is an illustrative view of a type of candlestick light providing the desired illumination required.

In the Drawings, the illuminated window display of the invention includes a candlestick light 10 preferably providing an illumination of the order of 10 watts or less—for example, 7 watts. A substantially vertical panel 12 is provided, having a rearwardly extending shelf 14 on which the candlestick light rests, and a pre-cut configured opening 16 for transmitting illumination from the light 10. Such shelf 14 may fold flat for storage along the fold-line 18, while a pair of wing sections 20 may be bent rearwardly along the fold-lines 22 to couple in any appropriate manner atop the shelf 14 (as at the slots 24) to be held in place in providing support to the candlestick light 10.

The panel 12, in this preferred embodiment, includes a holder 26 secured, for example, at its lower end 28, to receive one of a plurality of selectively interchangeable decorative displays 30 inserted via its upper end 32, or by either of the side openings of the holder, shown at 34. When translucent, the displays 30 transmit light through the panel opening 16 directly —or if opaque, by means of cut-outs in the display 30 which are in alignment with the opening 16. Such translucent display, or opaque cut-outs may be in the form of "heart shapes" (for a Valentine's Day presentation), "4-leaf clovers" (for a St. Patrick's Day presentation), "pumpkins" (for Halloween), "turkeys" (for Thanksgiving), "angels" (for Christmas), etc. As will be appreciated, the panel 12 could be constructed of a plastic or stiff cardboard composition so as to support the weight of the candlestick light 10.

Correlated with the decorative display 30 fitted within the holder 26 is one of a plurality of selectively interchangeable frames 36, also of a plastic or stiff cardboard composition, provided with its own window opening 38 aligned with the panel opening 16 and with the inserted decorative display 30. Such correlation would comport with the display—as a frame pattern of flowers for Valentine's Day, as a frame of Leprechauns, pots of gold and Shillelaghs for St. Patrick's Day, as a frame of goblins and ghosts for Halloween, and as a frame of Pilgrims and Native Americans for Thanksgiving. While such interchangeable frames may be imprinted with the correlated pattern, in other instances they may themselves be configured to provide the same desired effect—as by configuring a frame in the shape of a Christmas Tree to associate with a decorative display of Christmas Tree ornamentations, or in the configuration of alternating red and while colored stripes to join with a decorative blue display of stars for an Independence Day motif, or in the configuration of a Stork with a blue or pink window surround for a baby cut-out birth announcement decorative display. In any event, the particular decorative display is selected to go with the interchangeable frame decided upon in providing the correlated presentation which is afforded by the combination of the candlestick light illumination showing through the display 30, the configured pre-cut panel opening 16 and the provided window frame opening 38.

In this respect, it will be understood that the holder 26 receiving the decorative display 30 could be positioned on the candlestick light side of the substantially vertical panel 12 (in which case the display 30 is insertably securable between the candlestick light 10 and the panel 12) or on the interchangeable frame side of the panel 12 (in which event the display 30 is insertably securable between the panel 12 and the selected frame 36). In these regards, furthermore, the manner of securing the holder 26 on either side of the panel 12 can be selected from a variety of choices—such as by a hook-and-loop adhesive, by clips between components, by snaps between the two, by a slotting of one within the other, and by a myriad of other methods of temporary attachment. By having these components detachable, one-from-another, the substantially vertical panel 12 of the combination, the selectively interchangeable frame 36, and the interchangeable decorative display 30 could all be folded substantially flat for purposes of storage when not needed.

For certain installations, namely those where an adequate window sill is available for a candlestick light of this type to rest upon, the illuminated window display of the invention could sit there as well, with the light 10 resting atop the shelf 14. In those instances where an inadequate window sill support is available, the illuminated display of the invention may still be supported simply by providing an aperture through the frame 36 and panel 12 for a hook to be suspended in the hanging of the display itself. Such apertures are shown at 40 and 42 in the Drawings. Where added support for the candlestick light 10 is desired, the frame 36 could be provided with a further shelf 50, bendable along the fold line 52, to rest upon the window sill, for example, in receiving the shelf 14 of the substantially vertical panel 12 and the light 10 resting upon it. Other projections (as 53) may be bent and slots (as 54) provided, as needed in affording support—but with the overall result continuing to be the having of an illuminated window display with interchangeable designs through correlating selection of decorative displays and surrounding frames in providing the presentation desired to coincide with a holiday or occasion to be commemorated.

While there have been described what are considered to be preferred embodiments of the present invention, it will be readily appreciated by those skilled in the art that modifications can be made without departing from the scope of the teachings herein. Thus, as long as there continues an axial alignment of panel and window openings with the decorative and visual display intended, any manners of support, mounting, attachment and detachment may be utilized. For at least such reason, therefore, resort should be had to the claims appended hereto for a true understanding of the scope of the invention.

I claim:

1. An illuminated window display comprising:

a candlestick light;

a substantially vertical panel having a rearwardly extending shelf on which said candlestick light rests and a pre-cut configured opening for transmitting illumination therethrough;

one of a plurality of selectively interchangeable frames coupled with said panel, each with a window opening in alignment with said panel opening;

one of a plurality of selectively interchangeable decorative displays of predetermined design insertably securable between said candlestick light and said one frame in providing an illuminated presentation via said window opening;

with said one selected frame and said one selected decorative display being selected in correlation consistent in providing an overall theme to the illuminated presentation afforded thereby; and wherein said substantially vertical panel, said one selected decorative display and said one selected frame are each detachable and foldably flat for storage, and attachable and foldably openable for use.

2. The illuminated window display of claim 1 wherein said candlestick light is a candlestick bulb of the order of 10 watts or less.

3. The illuminated window display of claim 2 wherein said one decorative display is translucent to illumination from said candlestick light.

4. The illuminated window display of claim 2 wherein said one decorative display is opaque to illumination from said candlestick light, but with cut-outs therein through which said illumination is allowed to pass.

5. The illuminated window display of claim 1 wherein said one selected frame and said one selected decorative display are selected in correlation to provide an illuminated presentation consistent with a holiday season of the year.

6. The illuminated window display of claim 1 wherein said one selected frame and said one selected decorative display are selected in correlation to provide an illuminated presentation consistent with a secular or religious event or occasion.

7. The illuminated window display of claim 1 wherein said one decorative display is insertably securable between said candlestick light and said panel.

8. The illuminated window display of claim 1 wherein said one decorative display is insertably securable between said panel and said one selected decorative frame.

9. The illuminated window display of claim 1 wherein said substantially vertical panel, said one selected decorative display and said one selected frame are attachable for use by a hook-and-loop adhesive.

10. The illuminated window display of claim 1 wherein said selected decorative display is attachable for use by sliding within a holder on one of a front and rear side of said substantially vertical panel.

11. The illuminated window display of claim 1 wherein said substantially vertical panel and said one selected frame are of plastic composition.

12. The illuminated window display of claim 1 wherein said substantially vertical panel and said one selected frame are of stiff cardboard composition.

* * * * *